US006668801B2

(12) United States Patent
Smith et al.

(10) Patent No.: US 6,668,801 B2
(45) **Date of Patent: *Dec. 30, 2003**

(54) SUCTION CONTROLLED PUMP FOR HEUI SYSTEMS

(75) Inventors: Brian William Smith, Wooster, OH (US); Eric D. Ramseyer, Dalton, OH (US); Mark Douglas Correll, Bellville, OH (US)

(73) Assignee: Bosch Rexroth Corporation, Hoffman Estates, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/308,208

(22) Filed: Dec. 2, 2002

(65) Prior Publication Data

US 2003/0131826 A1 Jul. 17, 2003

Related U.S. Application Data

(63) Continuation of application No. 10/123,887, filed on Apr. 16, 2002, now abandoned, which is a continuation of application No. 09/849,636, filed on May 4, 2001, now Pat. No. 6,439,199, which is a continuation-in-part of application No. 09/553,285, filed on Apr. 20, 2000, now Pat. No. 6,227,167.

(51) Int. Cl.[7] ..... F02M 7/00; F04B 27/08

(52) U.S. Cl. ..... 123/446; 417/269

(58) Field of Search ..... 123/446, 447; 417/289, 295, 269, 490

(56) References Cited

U.S. PATENT DOCUMENTS

| | | | |
|---|---|---|---|
| 3,450,058 | A | 6/1969 | Stein |
| 4,719,889 | A | 1/1988 | Amann et al. |
| 4,884,545 | A | 12/1989 | Mathis |
| 5,191,867 | A | 3/1993 | Glassey |
| 5,458,103 | A | 10/1995 | Lauvin |
| 5,515,829 | A | 5/1996 | Wear et al. |
| 5,784,949 | A | 7/1998 | Ryken et al. |
| 5,788,469 | A | 8/1998 | Novacek et al. |
| 5,809,863 | A | 9/1998 | Tominaga et al. |
| 5,862,704 | A | 1/1999 | Seljestad |
| 5,884,606 | A | 3/1999 | Kellner et al. |
| 5,927,322 | A | 7/1999 | Rosenau |
| 5,957,111 | A | 9/1999 | Rodier |
| 5,971,718 | A | 10/1999 | Krueger |
| 6,035,828 | A | 3/2000 | Anderson et al. |
| 6,036,448 | A | 3/2000 | Fiddes |
| 6,058,912 | A | 5/2000 | Rembold |
| 6,074,175 | A | 6/2000 | Hoshi et al. |

(List continued on next page.)

FOREIGN PATENT DOCUMENTS

| | | |
|---|---|---|
| WO | 01/92709 | 12/2001 |

OTHER PUBLICATIONS

SAE Technical Paper 2000–01–0687, entitled "Development of a Variable–Displacement, Rail–Pressure Supply Pump for a Dimethyl Ether" by James C. McCandless. Ho Teng, and Jeffrey B. Schneyer presented Mar. 6–9, 2000.

Declaration of Inventor Brian William Smith, submitted herewith, executed Mar. 21, 2003.

*Primary Examiner*—Thomas N. Moulis
(74) *Attorney, Agent, or Firm*—Michael Best & Friedrich LLP

(57) ABSTRACT

A HEUI system uses a fixed displacement, piston pump to provide a generally constant pump flow of high pressure hydraulic fluid over the operating speed range of the pump to minimize parasitic power drains on the engine. The piston pump includes an orificing suction slot to vary the pump displacement over the operating speed of the pump. A throttling valve at the pump inlet may be provided to starve inlet fluid feed if reduced flow to the injectors is additionally required.

35 Claims, 10 Drawing Sheets

U.S. PATENT DOCUMENTS

| | | | | |
|---|---|---|---|---|
| 6,092,998 | A | | 7/2000 | Dexter et al. |
| 6,142,120 | A | | 11/2000 | Biester et al. |
| 6,217,289 | B1 | | 4/2001 | Smith |
| 6,223,725 | B1 | | 5/2001 | Onishi et al. |
| 6,234,148 | B1 | | 5/2001 | Hartke et al. |
| 6,253,734 | B1 | | 7/2001 | Rembold et al. |
| 6,345,608 | B1 | | 2/2002 | Rembold |
| 6,390,072 | B1 | | 5/2002 | Breeden |
| 6,427,663 | B1 | | 8/2002 | Breeden |
| 6,439,200 | B1 | * | 8/2002 | Majewski et al. ..... 123/446 |
| 6,460,510 | B1 | * | 10/2002 | Breeden ..... 123/446 |

* cited by examiner

SUCTION CONTROLLED PUMP FOR HEUI SYSTEMS

This invention is a continuation of Ser. No. 10/123,887 filed Apr. 16, 2002, now abandoned entitled "Suction Controlled Pump for HEUI Systems" hereby incorporated herein by reference in its entirety, which is a continuation of Ser. No. 09/849,636 filed May 4, 2001, now U.S. Pat. No. 6,439,199 entitled "Pilot Operated Throttling Valve for Constant Flow Pump" hereby incorporated herein by reference in its entirety, which is a continuation-in-part of Ser. No. 09/553,285, filed Apr. 20, 2000, now U.S. Pat. No. 6,227,167 ("the '167 patent") issued on May 8, 2001, also incorporated herein by reference in its entirety.

This invention relates generally to multiple piston pumps and more particularly to a high pressure pump used in a hydraulically actuated electronically controlled unit injector (HEUI) fuel control system. The invention is particularly applicable to and will be described with specific reference to a constant flow, fixed displacement pump and the integration of the fixed displacement pump into a HEUI system. However, those skilled in the art will appreciate that the invention may have broader application and may be integrated into other hydraulic pump driven systems, such as vehicular steering systems.

This invention also relates to a control system for a fixed displacement, constant flow pump and more particularly to a hydraulically actuated electronically controlled unit injector (HEUI) fuel control system using the fixed displacement constant flow pump. The invention is particularly applicable to and will be described with specific reference to a throttling valve controlling metering of low pressure fluid into a high pressure pump used in a HEUI flow control system. However, the invention has broader application and may be applied to other systems using a constant flow, fixed displacement pump requiring fast response over a wide range of operating conditions such as vehicular steering systems as mentioned above.

BACKGROUND

A) Conventional Systems

As is well known, a hydraulically-actuated electronically-controlled unit injector fuel system has a plurality of injectors, each of which, when actuated, meters a quantity of fuel into a combustion chamber in the cylinder head of the engine. Actuation of each injector is accomplished through valving of high pressure hydraulic fluid within the injector under the control of the vehicle's microprocessor based electronic control module (ECM).

Generally, sensors on the vehicle impart engine information to the ECM 25 which develops actuator signals controlling a solenoid on the injector and the flow of hydraulic fluid to the injector. The solenoid actuates pressure balanced poppet valves such as shown in U.S. Pat. Nos. 5,191,867 and 5,515,829 (incorporated by reference herein). The poppet valves in the injector port high pressure fluid to an intensifier piston which causes injection of the fuel at very high pressures. The pressure at which the injector injects the fuel is a function of the hydraulic fluid flow supplied the injector by a high pressure pump while the timing of the injector is controlled by the solenoid. Both functions are controlled by the ECM to cause precise pulse metering of the fuel at desired air/fuel ratios to meet emission standards and achieve desired engine performance. Tightening emission standards and a demand for better engine performance have resulted in continued refinement of the control techniques for the injector. Generally the pump flow output has to be variable throughout the operating range of the engine. For example, one manufacturer may desire a constant pump flow throughout an operating engine speed range except at the higher operating engine speeds whereat the injectors are valving so quickly reduced pump flow may be desired even though more fuel is being injected by the injectors to the combustion chambers. Other manufacturers may desire to rapidly change pump flow at any given instant for emission control purposes. For example, the ECM may sense a step load change on the engine and impose a change in the fuel/air ratio to overcome the effects of a transient emission. Still further, the operating vehicular environment severely impacts oil viscosity affecting pump flow and injector performance. Viscosity of the hydraulic fluid is affected by several variables besides heat and is difficult to program into the ECM to fully account for its affect on system performance.

In a HEUI system, high pressure hydraulic actuating fluid is supplied to each injector by a high pressure pump in fluid communication with each injector through a manifold/rail fluid passage arrangement. The high pressure pump is charged by a low pressure pump. As noted in the '867 patent, the high pressure pump is either a fixed displacement, axial piston pump or alternatively a variable displacement, axial piston pump. If a fixed displacement pump is used, a rail pressure control valve is required to variably control the pressure in the manifold rail by bleeding a portion of the flow from the high pressure pump to a return line connected to the engine's sump. For example, the '867 patent mentions varying the output of the high pressure pump by the rail pressure control valve to pressures between 300 to 3,000 psi. A variable displacement pump can eliminate the rail control valve if the flow output of the variable pump can timely meet the response demands imposed by the HEUI system. The pumps under discussion are axial piston pumps in which the pump stroke (displacement) is determined by the angle of the swash plate. Variable displacement, axial piston pumps use various arrangements to change the swash plate angle and thus the piston stroke. Generally speaking, variable output, axial piston pumps do not have the reliability of a fixed displacement, axial piston pump and are more expensive. More significantly, the response time demands for pump output flow in a HEUI system is becoming increasingly quicker and a variable pump may be unable to change output flow within the time constraints of a HEUI system unless a rail pressure control valve is used.

A fixed displacement, high pressure pump is typically used in HEUI systems because of cost considerations. The pump is sized to match the system it is applied to. It is well known that the flow of a fixed displacement pump increases, generally linearly, with speed. Accordingly, the fixed displacement pump is sized to meet HEUI system demands at a minimal engine speed which is less than the normal operating speed ranges of the engine. Higher engine speeds produce excess pump flow which is dumped by the rail pressure control valve to return. The excess flow represents an unnecessary power or parasitic drain on the engine which the engine manufacturers have continuously tried to reduce.

For example, U.S. Pat. No. 5,957,111 shows a control scheme in which excess pump flow is passed to an idle injector but at a rate insufficient to actuate the injector. The system is stated to allow elimination of the rail pressure control valve and permit a more accurate sizing of the fixed displacement pump. However, the system does not avoid unnecessary parasitic engine power drains imposed by the pump. The pump must still be sized to produce a set flow sufficient to actuate the injectors at a low speed and that flow increases with pump speed.

B) The '167 Patent

The '167 patent discloses a fixed displacement, axial pump which in contrast to conventional axial piston pumps, eliminates the kidney shaped ports, rotates the cylinder, fixes the swash plate against rotation and establishes an orificed, suction slot inlet for each piston. The suction slot draws a constant volume of fluid into each pump cylinder once pump operating speed is reached to produce a constant flow output from the pump. The pump can therefore be designed to produce the maximum flow required by the HEUI system (i.e., at low operating speeds) which maximum does not increase when pump speed increases as in conventional fixed displacement pumps. The power otherwise expended to drive conventional fixed displacement pumps beyond their designed "maximum" is not required. Improved vehicle performance, better fuel consumption and decreased emissions results because the parasitic power drain is removed.

Additionally, and as noted above, there are times during the vehicle's operation where less flow from the required "maximum" is sufficient to operate the injectors and desired for better injector performance, enhanced fuel consumption, etc. In the prior applications, it was demonstrated that controlling the flow of fluid to the constant volume high pressure pump by a throttling valve could produce a constant pump output flow at any desired level. The results and benefits achieved by the constant flow pump as discussed above relative to the maximum output sizing consideration, can therefore be achieved throughout the operating range of the pump by a throttling valve at the pump inlet. Parasitic power drains on the system are thus alleviated over the entire operating range of the engine.

The throttling valve generally disclosed in the '167 patent was simply a solenoid operated valve under the control of the ECM and similar to the high pressure, axial pressure control valve (RPCV) currently used in conventional systems. Because the solenoid valve is controlling the flow of a low pressure pump, its sizing is reduced decreasing its cost. While the solenoid operated valve can throttle the flow to the inlet of the constant flow pump, the viscosity changes in the hydraulic fluid such as the variations that can occur between ambient vehicular start-up temperatures and the sudden fluid flow changes occurring during normal operating conditions, such as that occurring during vehicle acceleration or deceleration, impose requirements on a conventional solenoid valve which are difficult to achieve.

SUMMARY OF THE INVENTION

It is therefore a principal object of the invention to provide a fixed displacement multiple piston pump which can be sized for a HEUI or other hydraulic system to alleviate or minimize engine power or parasitic drains imposed on the engine attributed to the associated bleeding of excess capacity pump flow.

This object along with other features of the invention is achieved by a constant flow, fixed displacement, piston pump which includes a non-rotatable cylinder containing a plurality of piston bores spaced about a centerline of the pump. A rotatable shaft having a formed shaft portion is journalled in the pump. Within each bore a piston is movable and has one end extending through a bore end and in contact with the formed shaft portion while the piston's opposite end is adjacent an outlet check valve at the opposite bore end. The pump has a discharge chamber in fluid communication with all piston outlet check valves and with the pump outlet. Each piston bore has suction slot of set area in fluid communication with the pump inlet which is sized as a function of timed flow through an orifice. The suction slot is transversely positioned at a set distance between the piston bore ends and sealed and opened by axial movement of each piston within its bore whereby fluid displaced into the piston bore decreases during the piston suction stroke in fixed relationship to increases in shaft rotational speed after the operating speed of the pump has been reached to produce a constant displacement pump throughout the operating range of the pump.

An important feature of the invention is achieved by an improvement to an internal combustion engine having a hydraulically actuated, electronically controlled fuel injection system of the type including a fuel injector valving high pressure fluid in response to commands from an ECM to timely inject a metered quantity of fuel to the engine's combustion chamber. The injector is in fluid communication with the outlet of the high pressure pump which in turn has an inlet in fluid communication with a low pressure pump. The improvement includes a fixed displacement high pressure pump, as described above, which produces a constant output flow of fluid at all operating speeds of the pump whereby the pump can be sized to match the flow demands of a HEUI system without placing excessive or unneeded power demands on the engine.

In accordance with another important aspect of the invention, the improved system includes the provision of a pressure control throttling valve at the inlet of the high pressure pump whereby the generally constant high pressure flow from the high pressure pump can be reduced to lower displacement flow values in response to commands from the ECM without placing any load on the engine to develop a pump pressure higher than what is required to actuate the HEUI system.

In accordance with another aspect of the invention, an annular discharge chamber is in fluid communication with the outlet check valve and the outlet port of the pump. The outlet check valve may be a reed flapper valve whereby high pressure fluid pumped by all cylinders in the pump is united in the discharge chamber to dissipate pump pulsations.

In accordance with a still further aspect of the invention, the high pressure pump has a housing defining a chamber therein and the cylinder is fixed to the housing which also journals the rotatable shaft therein. The housing also has an annular inlet chamber in fluid communication with the bore slots and a drain passage is provided for fluid communication between the housing chamber and the inlet chamber whereby internal pump leakage is drained through the pump inlet avoiding external pump drain lines when the pump operates in a hydraulic system where the pump inlet is not pressurized.

It is an object of the invention to provide a fixed displacement pump having generally constant output flow throughout its operating speeds.

It is a primary object of the invention to provide a fixed displacement pump for use in any vehicular hydraulic system driven by the vehicle's engine which reduces or minimizes the power drain imposed by the pump on the engine.

It is another object of the invention to provide a fixed displacement pump for use in a HEUI system which provides a constant flow of pressurized fluid over the operating range of the pump to allow a better and/or more consistent control of the injector over the operating range of the engine.

It is another object of the invention to provide a hydraulic circuit for actuating a hydraulically actuated electronically controlled fuel injector which delivers constant pump flow over an operating pump speed range with an ability to throttle the flow on demand while decreasing power demands of the pump on the engine.

Still yet another object of the invention is to provide a fixed displacement pump for use in a HEUI system which alleviates the need for a rail pressure control valve, or, alternatively, allows for use of a smaller, less expensive rail pressure control valve.

Still yet another object of the invention is to provide a fixed displacement pump which is able to provide fluid to a hydraulically actuated, electronically controlled fuel injector that simulates or improves upon the performance level achieved by a variable displacement pump.

Still yet another object of the invention is to provide an improved low cost high pressure pump for use in an HEUI system.

A still further general object of the invention is to provide a fixed displacement pump producing a constant flow of pressurized hydraulic fluid over an operating speed range of the pump for use in any number of vehicular hydraulic systems which use the power from the engine to control the hydraulic system.

These and other objects, features and advantages of the invention will become apparent to those skilled in the art upon reading and understanding the Detailed Description of the Invention set forth below.

BRIEF DESCRIPTION OF THE DRAWINGS

The invention may take form in certain parts and arrangement of parts, a preferred embodiment of which will be described in detail and illustrated in the accompanying drawings which form a part hereof and wherein.

Figure 1:
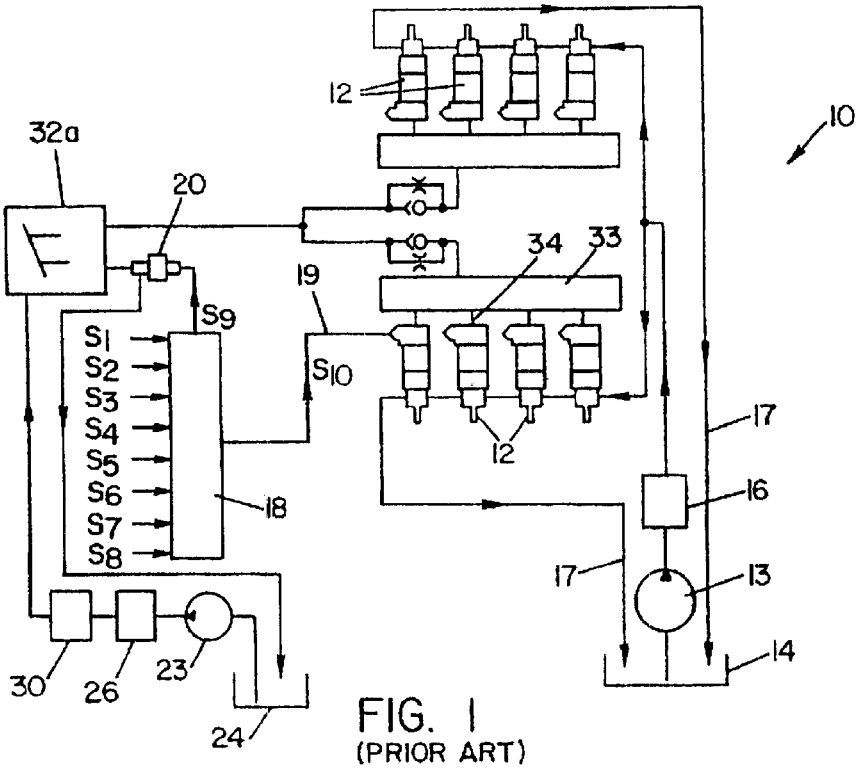
FIG. 1 (PRIOR ART)
FIG. 1 is a prior art schematic illustration of a HEUI fuel injection system.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION OF THE INVENTION

A) The HEUI System

Figure 2:
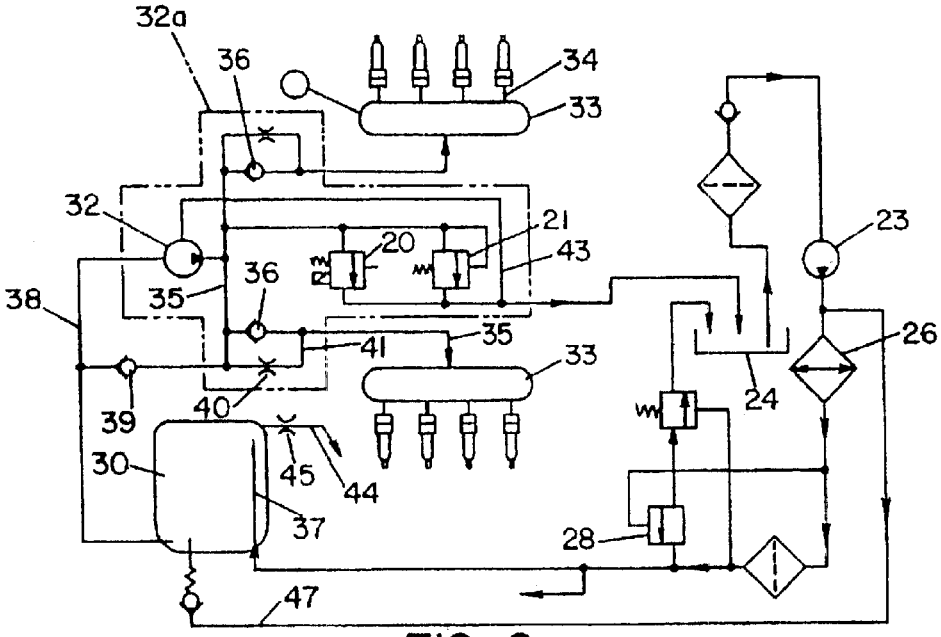
FIG. 2 (PRIOR ART)
FIG. 2 is a prior art schematic hydraulic actuating fluid circuit diagram for the injection system shown generally in FIG. 1.

Referring now to the drawings wherein the showings are for the purpose of illustrating a preferred embodiment of the invention only and not for the purpose of limiting the same, reference is first had to a description of a prior art HEUI system as shown in FIGS. 1 and 2 since the present invention may be perhaps best explained by reference to an existing arrangement.

The system shown in FIGS. 1 and 2 will only be described in general terms and reference should be had to the patents discussed in the Background for a more detailed explanation of the system including the operation of the fuel injector, per se, which is not shown in detail herein.

Referring first to prior art FIG. 1, there is diagrammatically shown an HEUI fuel injection system 10 which includes a plurality of unit fuel injectors 12. A fuel pump 13 draws fuel from the vehicle's fuel tank 14 and conditions the fuel at a conditioning station 16 before pumping the fuel to individual injectors 12 as shown. One or more fuel return lines 17 is provided. The fuel supply system as shown is separate and apart from the hydraulic system which actuates fuel injectors 12. It is understood that the engine fueled by injectors 12 is typically a diesel engine and that diesel fuel (fuel oil) can be optionally used as the fluid to power injectors 12. In the preferred embodiment, engine oil is used to actuate injectors 12. Those skilled in the art will recognize that the present invention is functional in those systems which use diesel fuel pumped under high pressure to actuate injectors 12.

Fuel injectors 12 are actuated by hydraulic pressure which, in turn, is regulated by signals generated by an electronic control module, ECM 18. ECM 18, in response to a number of sensed variables, generates electrical control signals which are inputted at 19 to a solenoid valve in each fuel injector 12 and to a rail pressure control valve 20 which determines the pressure of engine oil pumped to fuel injectors 12 by a high pressure pump 32.

More particularly, ECM 18 receives a number of input signals from sensors designated as S1 through S8. The sensor signals represent any number of variables needed by ECM 18 to determine fueling of the engine. For example, input signals can include accelerator demand or position, manifold air flow, certain emissions sensed in the exhaust, i.e., HG, CO, NOx, temperature, engine load, engine speed, etc. In response to the input signals, ECM accesses maps stored in look-up tables and performs algorithms, also stored in memory, to generate a fueling signal on S9 which is inputted as an electrical signal to rail pressure control valve 20 and a signal on S10 which takes the form of an electrical signal actuating a solenoid in injector 12. Injector 12 is entirely conventional and can take any one of a number of known forms. For purposes of this invention, it is believed sufficient to state that high pressure fluid from a high pressure pump is supplied to the injectors. The pump fluid, which is supplied to injectors 12 is, in the preferred embodiment, engine oil and drains from the injectors back to the engine sump (oil pan) through the engine's case (valve housing). Generally, pressure balanced poppet valves actuated by the solenoid, direct high pressure pump fluid against a pressure intensifier within injector 12. The pressure intensifier pressurizes diesel fuel to very high pressures (as high as 20,000 psi while high pressure pump pressure is not higher than about 4,000 psi) and ejects a pulse of fuel at this high pressure into the engine's combustion chamber. Poppet valve design, the staging or sequencing of the poppet valves, the degree of solenoid actuation, etc. will vary from one engine manufacturer to the next to generate a particular fuel pulse matched to the ignition/combustion characteristics of the combustion chamber formed by the geometry of the engine's piston/cylinder head. Various pulses such as square, sine, skewed, etc. can be developed by the injector 12 in response to solenoid signals from ECM 18.

As noted in the Background, the HEUI system has enjoyed its widespread acceptance because its operation is not affected by the speed or load placed on the engine. However, the HEUI system requires high pressure actuating fluid to operate and the flow rate of the fluid has to be variable on demand to produce the desired feed pulse from the injector. Again, how the pulse is developed is beyond the scope of this invention, it is sufficient for an understanding of the present invention to recognize that the pump supplying actuating fluid to the injectors must achieve a minimum flow rate which allows the injector to achieve maximum fuel pressure. Once the high pressure pump achieves this output, the HEUI system, through rail pressure control valve (RPCV) 20 may reduce the pump flow on demand for any number of reasons to produce a desired fuel pulse. For example, one engine manufacturer may desire a constant pump flow through the operating range except that at high operating engine speeds, the poppet valves within injectors 12 may cycle so quickly that it is desirable for pump flow to be reduced. That is the pressure of the fluid can be transferred instantaneously before the hydraulic fluid drain through the injector "catches up". Another manufacturer may sense load changes imposed on the engine and throttle the high pressure pump flow, at any engine operating speed, for emission purposes. In conventional systems, high pressure pump 32 supplies excess flow to injectors 12 which excess flow is returned to drain through RPCV 20 and the excess flow continues to increase as the pump speed increases. While rail pressure control valve 20 has been refined to timely respond to ECM demands, it should be clear that if the pump's excess flow can be reduced to more closely model system flow demands, the size (and expense) of rail pressure control valve 20 can be reduced.

As shown in prior art FIGS. 1 and 2, oil from the vehicle's conventional oil pump or low pressure pump 23 is cooled by a conventional radiator core 26. A low pressure oil stream produced by a pressure valve 28 fills a priming reservoir 30 which is in fluid communication with the inlet end of a high pressure pump 32. High pressure pump 32 includes the components shown in FIG. 2 within dot-dash line indicative of pump housing 32*a*. High pressure pump 32 pressurizes the engine oil at the high pressure pump's outlet (now termed actuating oil) which is in fluid communication with common rail passage 33 in the manifold which, in turn, is in fluid communication with rail branch passages 34 leading to actuating ports within individual fuel injectors 12. In the prior art arrangement shown in FIGS. 1 and 2, a vee-type engine is used so there are two manifolds and two sets of rails. Also, for convenience in notation, reference to "rail" means the common rail passage 33 and rail branch passages 34 and can optionally include the actuating oil supply line 35 leading from the outlet of high pressure pump 32 to the manifold. When high pressure pump 32 is operating, pressure of the actuating oil in manifold/rail passages 33, 34 as noted above is determined by the actuation of rail pressure control valve 20 which is backed up with a safety relief valve 21.

Referring now to prior art FIG. 2, priming reservoir 30, in addition to functioning as an oil reservoir supplying oil to the inlet of high pressure pump 32, functions also as a reservoir to maintain oil in the high pressure pump inlet supply line 38 and oil in high pressure pump 32 as well as oil in the manifold/rail passages 33, 34 when high pressure pump 32 doesn't operate. This is achieved by physically positioning priming reservoir 30 at an elevation above the inlet port of high pressure pump 32 and above manifold/rail passages 33, 34 and specifically, the use of a stand pipe 37 at that elevation to establish a gravity flow from priming reservoir 30. Make-up oil flows past a one way check valve 39 (oil ferry) through an optional flow restriction orifice 40 in a bypass line 41 which communicates with actuating supply line 35. Orifice 40 in combination with check valves 36 also functions to control Helmholtz resonance for balancing pressure surges or waves between the two manifolds for the vee-type engine illustrated. The make-up oil from priming reservoir 30 thus flows to the actuating supply line 35 and then to manifold/rail passages 33, 34. Make-up oil also flows through actuating supply line 35 to the outlet of high pressure pump 32. Leakage within high pressure pump 32 returns to crank case sump 24 through a fluid leakage supply line 43. When priming reservoir 30 is filled by low pressure pump 23 excess oil and air is vented for return to crank case sump 24. In the prior art FIG. 2 this occurs through an overflow return line 44 which includes an orifice 45 to maintain a slight pressure in priming reservoir 30. It is or should be clear that in the HEUI system embodiment shown in FIGS. 1 and 2, the inlet of high pressure pump 32 during engine operation is charged through reservoir 30 at the pressure of low pressure pump 23.

This invention, in its broad sense, is not limited to a HEUI system. However, like the HEUI system disclosed in FIGS. 1 and 2, a source of fluid, at some low pressure, must be available to charge the inlet of the high pressure pump.

B) The High Pressure Pump

Figure 3:
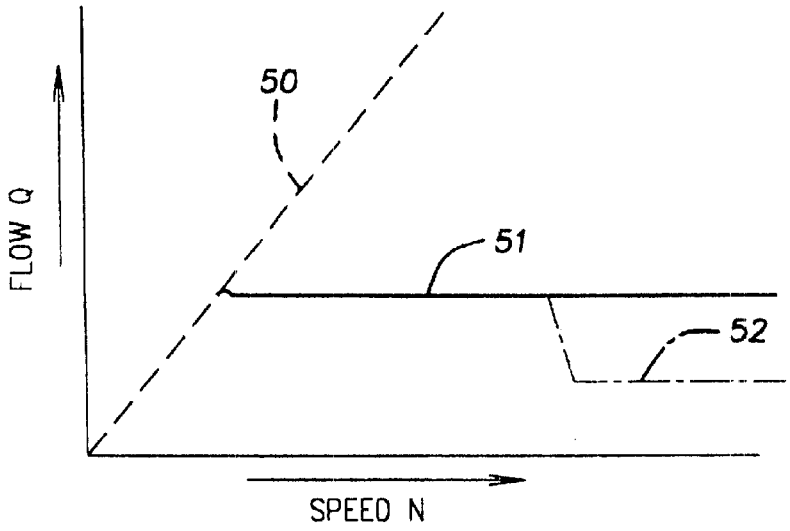
FIG. 3 is a constructed graph of pump flow versus speed for a conventional fixed displacement pump and for the fixed displacement pump of the present invention.

Referring now to FIG. 3, there is shown a constructed graph plotting pump speed along the x-axis and pump flow along the y-axis for a fixed displacement pump. As is well known, pump flow increases, generally linearly, as a function of pump speed for a fixed displacement pump as shown by the dotted trace 50. For reasons which will be explained in detail below, pump 55 of the present invention operates as a conventional fixed displacement pump in the sense that increasing pump speed increases pump flow. However, in the present invention, when a pump critical speed, hereinafter termed "operating speed", is reached, the pump flow is constant notwithstanding increases in pump rotational speed. The operating speed of pump 55 of the present-invention is shown by the solid line indicated by reference numeral 51. Further, for reasons discussed below it is possible for the pump flow of pump 55 to be decreased at any operating pump speed and this is indicated by dot-dash line 52 in FIG. 3.

Figure 4:
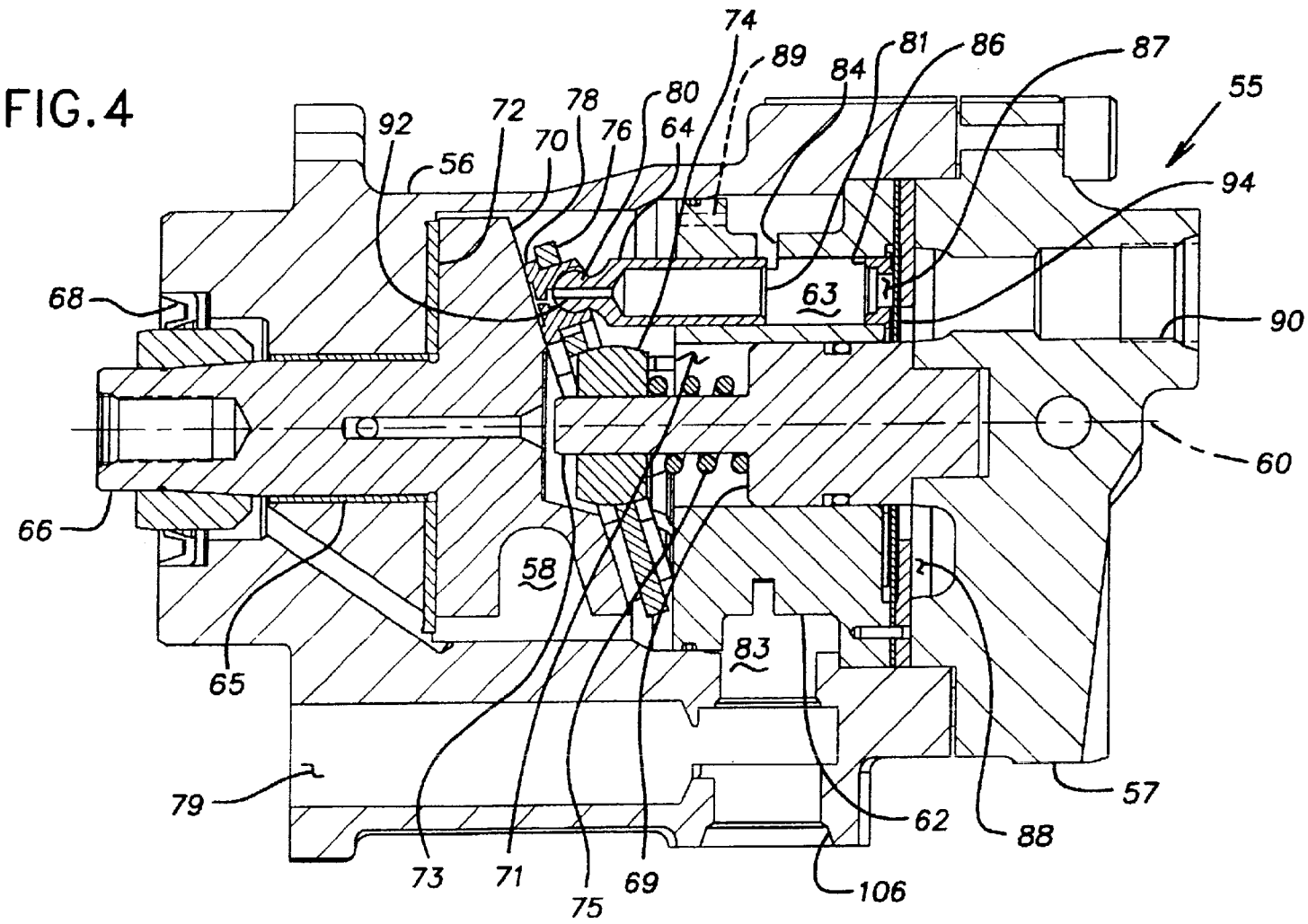
FIG. 4 is a sectioned side elevation view of the fixed displacement pump used in the present invention.
Figure 4A:
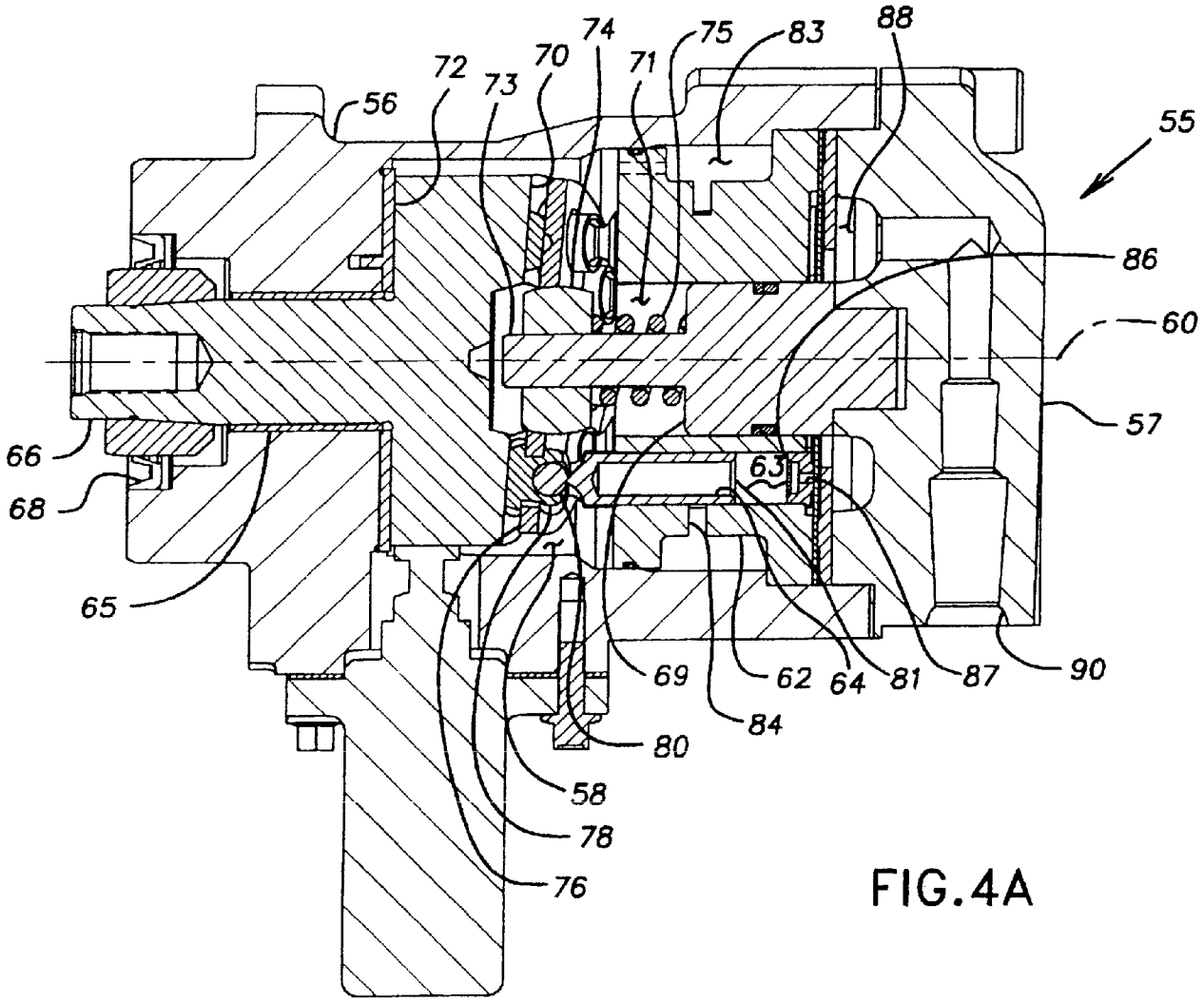
FIG. 4A is a sectioned elevation view similar to that shown in FIG. 4 but through a section about 90 degrees to the pump section shown in FIG. 4.

Referring now to FIGS. 4 and 4A, high pressure fixed displacement axial piston pump 55 includes a pump body 56 which is sealing secured to an end body casting 57 to define a body chamber 58 extending along pump centerline 60. Fixed to pump body 56 and end body casting 57 is a piston cylinder 62 containing a plurality of piston bores 63 circumferentially spaced about pump centerline 60. Disposed and axially movable within each piston bore 63 is a piston 64.

Journalled within body chamber 58, as by a sleeve bushing 65, is a gear driven shaft 66. Shaft 66 is rotatably sealed within body chamber 58 by a shaft seal 68 at one end. A portion of shaft 66 is formed as a swash plate 70, one end of which contacts a thrust bearing 72. Alternatively, swash plate is affixed or keyed to shaft 66 so as to be rotatable therewith. A tail shaft 69, longitudinally extending along centerline 60, is received within a central opening 71 extending through piston cylinder 62 and seated against a central recess in end body casting 57. Tail shaft 69 has a necked down stem portion 73 extending out of central opening 71 which receives a spherical bearing 74. Spherical bearing 74 is biased by a spring 75 in a direction that pushes spherical bearing 74 off stem 73 and is retained in the assembled position shown in FIGS. 4 and 4A because it engages, at its spherical bearing surface, a central opening in a slipper retainer plate 76. The circular central opening in slipper retainer plate 76 has a diameter less than the outside spherical diameter of spherical bearing 74. Slipper retainer plate 76 has circumferentially spaced, radially outward openings that receive and maintain socket shaped slippers 78 in contact with swash plate 70 and each piston 64 has a ball end 80 received within the socket of an associated slipper 78. Thus, pistons 64, which are fixed (although longitudinally movable) vis-a-vis stationary piston cylinder 62, likewise fix slippers 78 vis-a-vis the ball/socket connection which in turn fix the position of slipper retainer plate 76 and slipper retainer plate 76 prevents spherical bearing 74 from leaving stem portion 73 under the bias of spring 75. Spring 75 thus maintains, through the connections described, slippers 78 in contact with swash plate 70 while slipper retainer plate 76 pivots or swivels about spherical bearing 74 upon rotation of swash plate 70 relative to piston cylinder 62. Note that while tail shaft 69 is not rotated by gear driven shaft 66, tail shaft 69 and the opening in spherical bearing 74 which receives stem portion 73 are cylindrical in the preferred embodiment. This may enhance the swivel/pivoting motion of slipper retainer plate 76 relative to spherical bearing 74. Other arrangements can be employed to allow rotation of swash plate 70 relative to fixed piston cylinder 62 while maintaining a spring bias against spherical bearing 74. However, the general arrangement of slipper retainer 76/spherical bearing 74 with the spherical bearing spring biased to a set axial position by spring 75 centered on centerline 60 produces a stable arrangement allowing for smooth axial motion of pistons 64 throughout the speed ranges of pump 55. Other arrangements use offset varying spring forces in the piston bore to maintain slipper/swash plate contact.

As described thus far, pump 55 is different from typical axial piston pumps in which the cylinder rotates relative to a stationary swash plate. In pump 55, rotation of swash plate 70 causes piston 64 to axially move in bore 63 through spherical bearing 74, retainer plate 76 and slippers 78/piston ball end 80. For definition, rearward (toward the left when viewing FIG. 4) movement of piston 64 out of bore 63 at the ball end 80 side of piston 64 is a "suction stroke" of piston 64 while forward (towards the right when viewing FIG. 4) movement of piston 64 into piston bore 63 produces a "compression stroke" of piston 64. Movement of piston 64, caused by relative rotation of swash plate 70 and piston 62, is conventional, although typically swash plate 70 is stationary.

Adjacent the forward end 81 of piston 64, a vent insert 86 is inserted at the discharge end of piston bore 63. Vent insert 86 has a vent orifice 87 formed therein which communicates through a one-way check valve with an annular discharge chamber 88 formed in end body casting 57 which in turn is in fluid communication with a pressurized outlet port 90 of pump 55. Unlike traditional axial piston pumps, there are no kidney shaped inlet and outlet passages in fluid communication with the piston bore vent orifice as the piston cylinder rotates to sequentially communicate the vent orifice with a kidney shaped inlet passage during the piston's suction stroke and with a kidney shaped outlet passage during the piston's compression stroke. In the traditional axial piston pump, when the piston bores rotate to switch from the inlet kidney shaped passage to the outlet kidney shaped passage, the bores pass over lands which produce or contribute to pulsation of the fluid, especially at high pump speeds. This is avoided or minimized in pump 55 by having all piston bores 63 communicate through a check valve with a common annular discharge chamber 88 which unites or unifies the flow from piston bore 63 during the compression stroke of piston 64 while the check valve prevents flow of fluid from annular chamber 88 into piston bore 63 during the suction stroke of piston 64. While annular discharge chamber 88 could be a centrally positioned chamber and relatively large, preferably, it is ring shaped and in the nature of a passageway, as shown in FIG. 4, which has been found to produce consistent, somewhat non-pulsing flow through outlet port 90.

Figure 6:
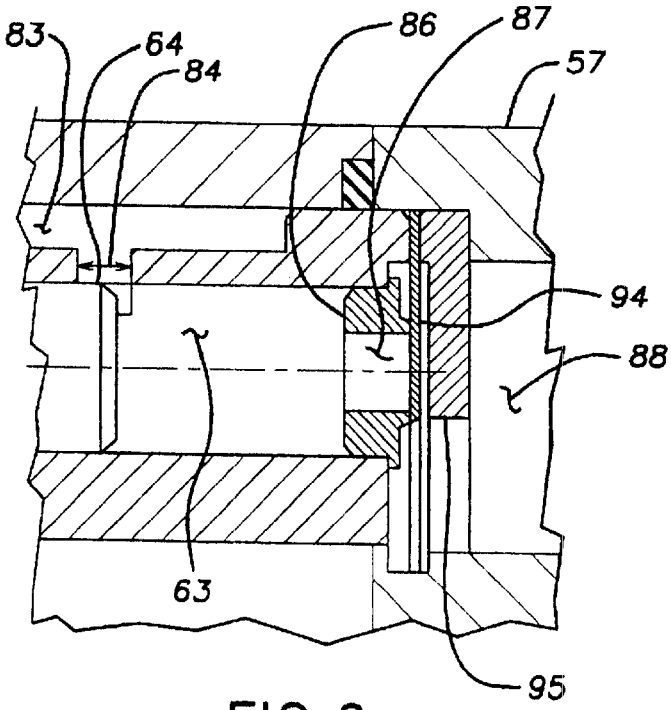
FIG. 6 is an enlarged view of a portion of the piston bore seal of the pump of the present invention.

As best shown in FIGS. 4 and 6, pump body 56 has an inlet passage 79 which is in fluid communication with an annular inlet chamber 83 in piston cylinder 62 that terminates at an orificing slot 84 that establishes an opening in piston bore 63. In the preferred embodiment, slot 84 is opened for some travel distance of piston 64 during the suction stroke and closed during the compression stroke of the piston. In the preferred embodiment, hydraulic fluid at inlet passage 79 is at low pressure (about 20–60 psi) from low pressure pump 23. Fluid flows through orificing slot 84 during the time slot 84 is opened establishing an orifice in fluid communication with piston bore 63. As the speed of the pump increases, the time that slot 84 is opened during the suction stroke of piston 64 decreases. Accordingly, successively smaller quantities of fluid enter piston bore 64 during the suction stroke as pump speed increases to produce a constant flow of fluid from outlet port 90.

Specifically, the variable output of pump 55 is achieved by sizing suction slot 84. Flow is controlled through suction slot 84 by the orifice equation:

$$QA\cdot\Delta P^{1/2}\cdot t$$

Where "Q" is the flow, i.e., the quantity of fluid flowed for a time through the slot, "A" is the area, "ΔP" is the pressure drop across the slot, and "t" is the time the slot is open. The maximum displacement is achieved when time is of a magnitude that causes no limitation on the flow, i.e., it is of sufficient duration to fill the piston bore volume. That is to say, for maximum pump displacement the only controlling factors are the size of the orifice and the pressure drop. Time is inversely proportional to pump speed and causes no limitation on flow up to a certain critical or "operating" pump speed. Beyond that critical or operating speed, the flow through slot 84 is limited causing a constant amount of flow regardless of speed.

Figure 8:
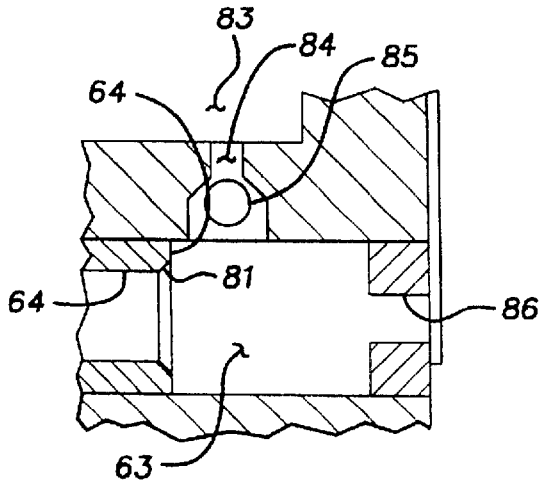
FIG. 8 is a partial sectioned view showing a modification to the suction slot and pump of the preferred embodiment.

In the preferred embodiment, slot 84 is positioned rearwardly in piston bore 63 as shown in FIGS. 4 and 6. However, other arrangements such as shown in FIG. 8 are possible. In FIG. 8, suction slot 84 is positioned forwardly in piston bore 63 and equipped with a ball check valve 85. Slot 84 is thus open for a longer travel distance during the suction stroke of piston 64 than that shown in FIGS. 4 and 6. However, in accordance with the orifice equation above, the size of slot 84 is controlled to produce constant flow over the operating speed. Other slot arrangements will suggest themselves to those skilled in the art. Conceptually, suction slot 84 could be positioned rearward in piston bore 63 so that it is not uncovered by piston 64 and piston could have an orifice opening in its sidewall, fitted with a check valve, allowing fluid to pass through piston 64 to fill piston bore 63 during the suction stroke. All of these arrangements establish an orifice, of a preset size, which is in timed fluid communication with inlet fluid to vary the volume of fluid admitted to piston bore 63 as a function of pump speed. In contrast, axial piston pumps which do use a stationary swash plate maintain fluid communication with the inlet throughout the suction stroke by a feed arrangement which assures filling the piston bore with fluid.

In the embodiment of pump 55 illustrated in FIG. 4, forward end 81 of piston 64 is open and a bleed passage 92 formed in piston ball end 80 provides forced lubrication to slipper/swash plate contact surfaces. Optionally, if pump 55 is not charged with pressurized inlet fluid at inlet 79, internal leakage within pump which collects in body chamber 58 can be routed back to drain through inlet 79 by the provision of an optional drain passage 89 providing fluid communication between body chamber 58 and inlet chamber 83. Pump 55 may not be charged with pressurized inlet fluid in vehicular hydraulic steering applications. In the HEUI system described in FIGS. 1 and 2, pump inlet 79 is at low pressure and pump leakage occurs at front shaft seal 68 which is conventional.

Figure 5:
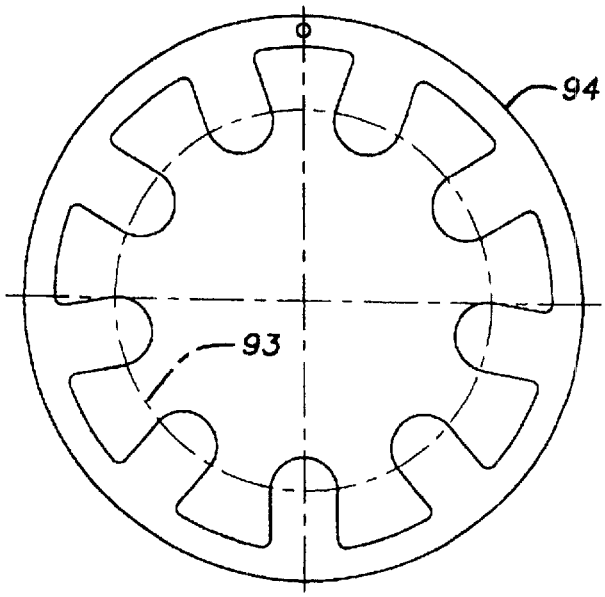
FIG. 5 is a plan view of the reed flapper valve used in the pump.
Figure 9:
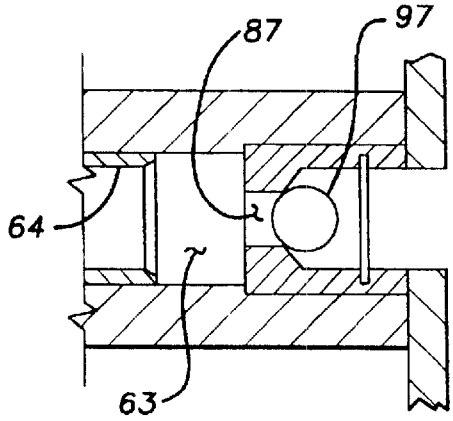
FIG. 9 is a sectioned view showing a modification to the vent orifice of the pump.

As noted, output of fluid from all piston bores 63 is united or unified in annular discharge chamber 88 which has the effect of dampening pulsations attributed to any specific piston 63 during its pressure stroke. In order to prevent back flow of pressurized fluid into piston bores 63 having pistons in a suction stroke travel mode, a check valve is positioned at the outlet of vent orifice 87. In the preferred embodiment, a reed type flapper valve 94, best shown in FIGS. 5 and 6, is positioned at the outlet of vent orifice 87 and held in spaced relationship by a vent plate 95 as shown in detail in FIG. 6. Flapper valve 94 closes when the pressure of the fluid in piston bore 63 is less than the pressure of the fluid in outlet chamber 88. Flapper valve 94 opens when the pressure of the fluid within piston bore 63 equals or exceeds the pressure of the fluid in annular outlet chamber 88. In the preferred embodiment, as shown in FIG. 5, pump 55 has nine piston bores 63 and the relative diameter of discharge chamber 88 is shown by dot-dash circle 93. An alternative to reed flapper valve 94 is a check valve such as ball check valve 97 fitted into vent insert 86 as schematically illustrated in FIG. 9.

Figure 7:
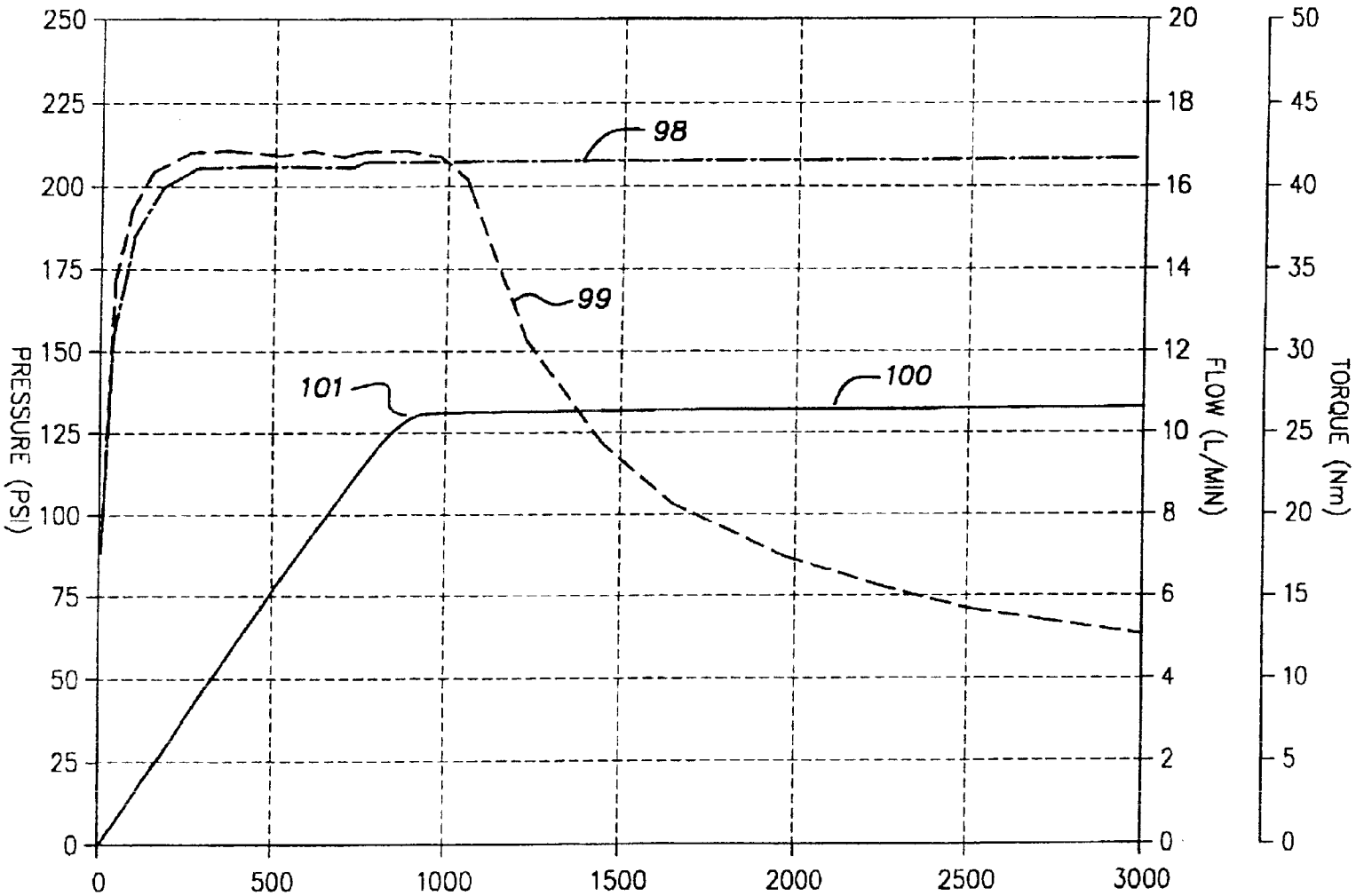
FIG. 7 is a constructed graph showing plots of pump flow, pressure and torque versus speed of the pump used in the present invention.

Reference can now be had to FIG. 7 which is a constructed graph showing performance of the pump design of FIG. 4. Pump pressure is shown as the trace passing through dot dash line indicated by reference numeral 98. Pump torque is shown by the trace passing through dash line indicated by reference numeral 99 and pump flow is shown by the trace passing through solid line indicated by reference numeral 100 at various rotational speeds of shaft 66. FIG. 7 was constructed with inlet pump pressure at one atmosphere and pump fluid at 120 degrees F. As pump speed increases, flow of fluid through suction slot 82 increases with increasing pump speed until a critical or operating speed of the pump is reached whereat a knee 101 is formed in flow curve 100. In the graph of FIG. 7, the flow limiting critical or operating speed of the pump is shown to occur at about 900 rpm. As trace 100 shows, further increase in speed of the pump during this operating range does not result in fluid flow increases. As a matter of definition and as used herein and in the claims, "operating speed" of pump 55 means the speeds at which pump 55 generally produces constant output flow as shown, for example, by trace 100 after knee 101. It should also be noted that torque curve 99 shows torque decreasing with increases in pump speed during the "operating speed" of pump 55. Torque decreases due to the relationship between torque and effective displacement. That is, $$TN \cdot D$$

Where "T"=torque, "N"=speed and "D" is effective displacement. Effective displacement of fluid from each piston bore 63 decreases during the suction stroke as explained above. Further, for a constant inlet pressure producing a constant pressure drop, it is possible to control the start of the "operating speed" or knee simply by sizing only the slot area.

Figure 10:
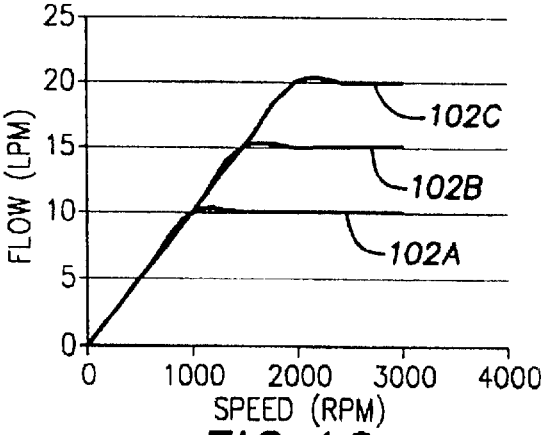
FIG. 10 is a constructed graph showing various flow rates achieved by the pump of the present invention.

It is also possible to achieve secondary control of variable pump displacement output by controlling the pressure of the fluid at the inlet side of suction slot 82. In the HEUI application, and as noted, low pressure pump typically delivers fluid at inlet 79 at about 20–60 psi. This affects flow through suction slot 82 by the orifice equation set forth above. Changing inlet pressure changes the pressure drop across the orifice and produces a different flow curve. This is best shown by reference to FIG. 10 which shows operating speed flow curves 102A, 102B and 102C. Inlet pressure is constant for each curve but the inlet pressure for curve 102A is less than that for inlet curve 102B which is less than that for inlet curve 102C. In each case, an operating speed is reached whereat constant pump flow occurs but knee 101 at which the pump transitions to its operating (or critical) speed shifts with increasing inlet pressure. FIG. 10 shows that it is possible, by throttling the inlet flow, to variably control the pump's output flow when the pump is within its operating speed range. That is, the output flow of pump 55 at any speed within the pump's operating speed can be controlled by throttling the inlet flow such as shown by curve portion 52 of FIG. 3. Conceptually, placing RPCV 20 upstream of pump 55 can achieve the valving now achieved by RPCV 20 downstream of conventional high pressure pump 32 but without the parasitic power drain of a conventional high pressure pump 32.

Figure 11:
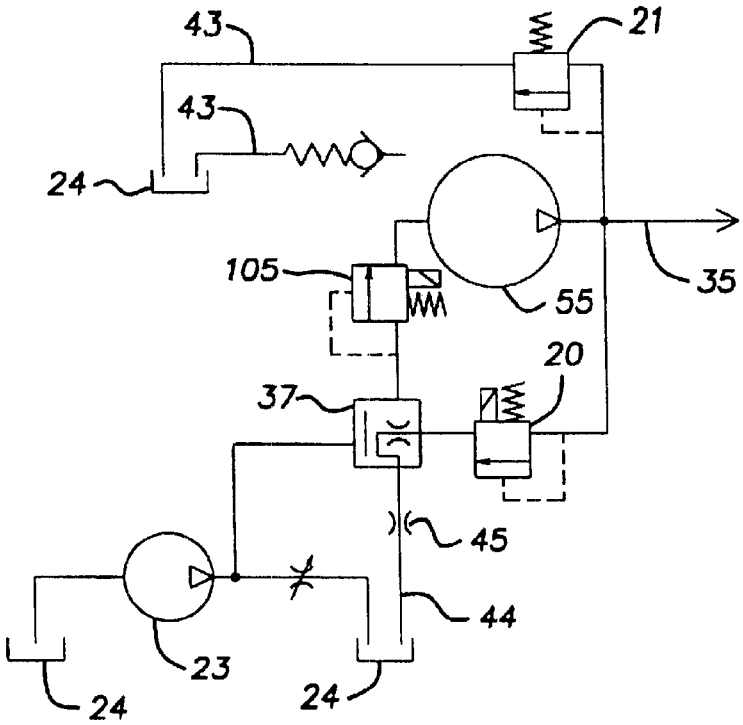
FIG. 11 is a schematic hydraulic circuit of the present invention similar to FIG. 2.

Referring now to FIG. 11, there is shown a portion of the hydraulic circuit shown in FIG. 2 of the prior art modified to incorporate the operating characteristics of pump 55. Components illustrated in FIG. 11 which are functionally similar to the components illustrated and discussed above with respect to prior art FIGS. 1 and 2 will be assigned the same drawing reference numerals as that used in describing the prior art. More particularly, FIG. 11 is characterized by the addition of a solenoid operated throttling valve 105 functionally similar to RPCV 20 and actuated by ECM 18. That is, ECM 18 knows the constant flow of axial piston pump and actuates throttling valve 105 to drop the constant flow to any lesser value. (A throttling valve port shown by reference numeral 106 in FIG. 4 is in fluid communication with inlet port 79.) The constant flow value is set at minimum system flow requirements plus a safety factor required by the system. In the preferred embodiment, RPCV 20 is eliminated from FIG. 11. It is shown in FIG. 11 because of a slight fractional second delay which can elapse from the time throttling valve 105 is actuated to the time the reduced flow appears at pump outlet 90. Some manufacturers may desire a millisecond response so RPCV 20 is shown in FIG. 11. In such instance, ECM has to co-ordinate throttling valve 105 and RPCV 20. A downsized RPCV 20 would be employed and actuated, in theory, for a fractional second until pump output realized the setting of throttling valve 105. Alternatively, RPCV 20 can be eliminated.

C) The Throttling Valve

As discussed above and illustrated in FIG. 11, the RPCV 20, which was heretofore placed downstream of high pressure pump 55, can be placed upstream of the high pressure pump to avoid the parasitic power drain of the conventional high pressure pump 32 (FIGS. 1 and 2). Solenoid throttling valve 105 functions to control the pressure (and flow) of the low pressure pump to high pressure pump 55 in response to commands from the ECM. This system is functional. However, it has been determined that because of viscosity changes or ranges of viscosity of the hydraulic oil to which the pump is subjected and because of the different flow rates which have to be throttled, solenoid valves of considerable size (having power to infinitely change flow rates over large operating flow conditions at various viscosities) and expense are required. This is so even considering that the solenoid valve is controlling the flow of a low pressure pump and not a high pressure pump. The throttling valve of this invention allows the solenoid valve to be considerably downsized and operate within the broad operating ranges required of a HEUI system.

Figure 12:
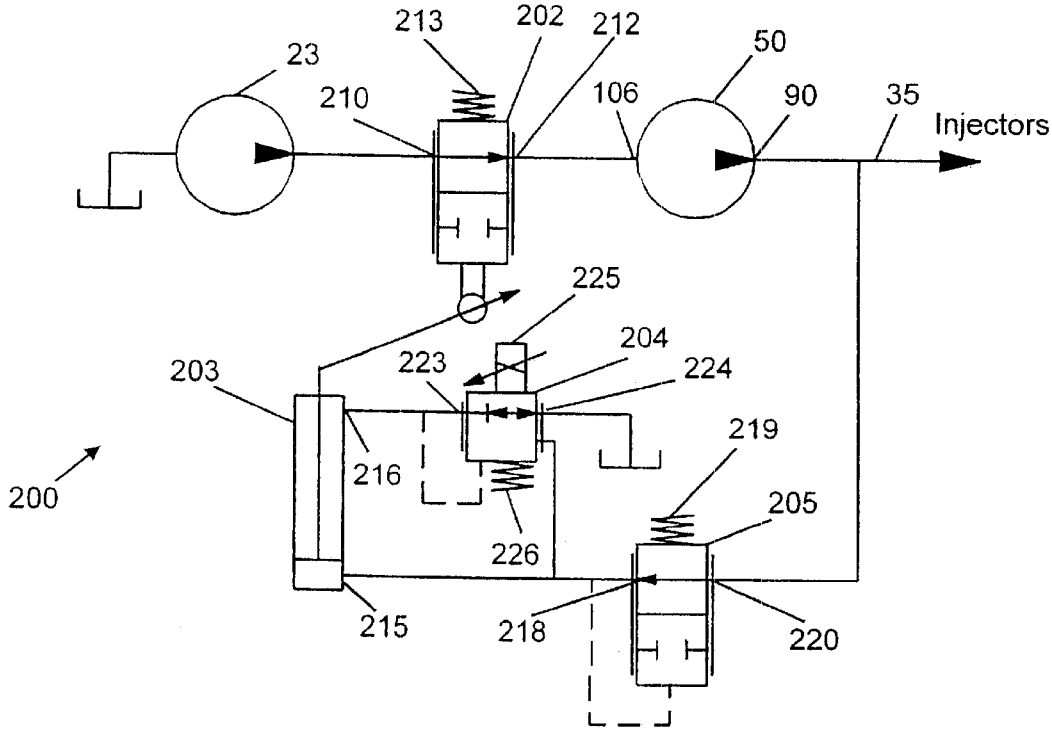
FIG. 12 is a schematic hydraulic circuit similar to FIG. 11 but schematically showing the components of the throttling valve of the present invention.

Referring now to FIG. 12, there is schematically depicted throttling valve 200 positioned between low pressure or charge pump 23 and high pressure pump 55 for the HEUI system discussed above. Throttling valve 200 can be viewed as functionally including a flow control valve 202, a mechanical actuator 203, a solenoid operated, pressure reducing or control valve 204 and a pressure regulating valve 205.

As discussed, low pressure fluid (at 20 to 60 psi) from charge pump 23 enters inlet 210 of flow control valve 202 at an initial charge pump pressure, $P_{11}$. Flow control valve 202 meters charge pump pressure $P_{11}$ to a desired flow control outlet pressure which is outputted at flow control valve outlet 212 and inputted to inlet 106 of high pressure pump 55 at a desired high pressure inlet pump pressure, $P_{12}$. High pressure pump 55 generates high pressure outlet pump pressure $P_0$ at pump outlet 90 transmitted to the injectors from rail 35. In the preferred embodiment, for a constant high pressure inlet pump pressure $P_{12}$, high pressure pump 55 produces, at operating pump speeds, a generally constant outlet flow which is at a generally constant high pressure outlet pump pressure $P_0$.

As schematically indicated in FIG. 12, flow control valve 202 is biased by a spring 213 into, for the preferred embodiment, a full open position. Mechanical actuator 203 opposes the bias of spring 213 and if the mechanical force of mechanical actuator 203 overcomes the bias of spring 213, flow control valve 202 will be moved into a closed position whereat high pressure pump inlet pressure $P_{12}$ will reduce to zero. The force developed by mechanical actuator 203 is a function of the differential in pressure between two fluid pressures exerted at opposite sides or spool ends of mechanical actuator 203. Fluid at a regulated pressure, $P_R$, is introduced at a closing end 215 of mechanical actuator 203 and the force developed by regulated pressure $P_R$ is counterbalanced by fluid at a control pressure, $P_C$ introduced at a counterbalancing or control end 216 of mechanical actuator 203. Mechanical actuator 203 controls flow control valve 202 which is thus a slave to the actuator.

Regulated pressure $P_R$ is produced at an outlet 218 of pressure regulating valve 205 which is a conventional regulating valve using a preset bias of a spring 219 to drop the pressure of high pressure pump output $P_0$ introduced to regulating valve inlet 220 to produce regulated pressure $P_R$. Regulating valve 205 does not meter any appreciable flow of fluid from high pressure pump output to drain (not shown in schematic of FIG. 12) and does not materially change high pressure pump output pressure $P_0$ in rail 35. If high pressure pump output $P_0$ drops to an unactuated pressure, i.e., engine shut-off condition, regulating valve spring 219 will open fluid communication between regulating valve inlet and outlet 220, 218 so that fluid remains in mechanical actuator 203 at some nominal pressure.

Fluid at control pressure $P_C$ is produced at an outlet 223 of pressure control valve 204. Fluid at regulated pressure $P_R$ from outlet 218 of regulating valve 205 is introduced at an inlet 224 of pressure control valve and metered to a set pressure by a solenoid 225 acting against the bias of a pressure control spring 226. Solenoid 225 is under control of ECM 18 and has the ability to meter flow through pressure control valve 204 from zero to regulated pressure $P_R$. In event of solenoid failure, fluid communication from regulating valve outlet 218 to control valve outlet 223 is closed thus forcefully biasing actuator 203 and consequently valve 202 to the closed position preventing the supply of oil from pump 55 to rail 35.

In the preferred embodiment and on start-up of a cold engine, high pressure pump output $P_0$ will be insignificant and fluid connections 220, 218 along with fully actuated solenoid 225 and fluid connection 218, 223 will place balancing forces on mechanical actuator 203 so that pressure in passages 215 and 216 are equal. Consequently, flow control spring 213 will bias flow control valve 202 into a full open position. Thus maximum flow to high pressure pump inlet 106 will occur. During engine warm-up, high pressure pump 55 will develop sufficient pressure to allow pressure regulating valve 205 to function at which time pressure control valve 204 will likewise function. In the preferred embodiment and in the event of an electrical failure of solenoid 225, pressure control valve 204 is designed to reduce control pressure $P_C$ to zero with the result that regulated pressure $P_R$ only acts on mechanical actuator 203. Regulated pressure $P_R$ is set to be sufficient to overcome the bias of flow control spring 213 and close or materially reduce the flow of fluid through flow control valve 202. The result is then that high pressure pump 55 is starved for fluid and the engine stalls because there is insufficient pressure to operate the fuel injectors. Alternatively, the setting of regulated pressure $P_R$ coupled with the setting for spring bias 213 and the design of flow control valve 202 (as explained below) can be set such that when electrical failure of solenoid 225 occurs, there is sufficient high pressure pump inlet pressure $P_{12}$ to allow the fuel injectors to minimally operate. The vehicle could then operate in a "limp home" mode.

It should be clear from the discussion of FIG. 12 that there is, for all intents and purposes, an insignificant flow of fluid through pressure control valve 204 and pressure regulating valve 205 or the mechanical actuator 203. Thus the functioning of the components which regulate flow control valve 202 are isolated from the effects of viscosity or changes in the viscosity of the fluid flowing through flow control valve 202. Parasitic power losses are also minimized due to minimal flow losses.

Further, the regulating pressure $P_R$ (while higher than charge pump pressure $P_{11}$) is set at a relatively low value when compared to the pump output pressure $P_0$. This relatively low pressure lends itself to rapid and responsive modulation through pressure control valve 204. Solenoid 225 can be selected as a small sized, low cost but truly responsive item. By way of example and not necessarily limitation, in the preferred embodiment, initial charge pump pressure $P_{11}$ can range from 0 to 7 bar; high pressure inlet pump pressure $P_{12}$ can range from [(0 to 7 bar)−1]; high pressure outlet pump pressure $P_0$ can range from 0 to 280 bar; regulated pressure $P_R$ is set at a constant pressure established by the relationship of spring 213 and valve 204 (The preferred embodiment utilizes production established components and a 32 bar setting. Other settings are possible.) and the control pressure $P_C$ can vary from 0 to 18 bar. The flow range of low pressure pump is 0–25 Lpm and the viscosity range of the fluid, which in the preferred embodiment is engine oil, is 8–10,000 cSt.

Figure 13:
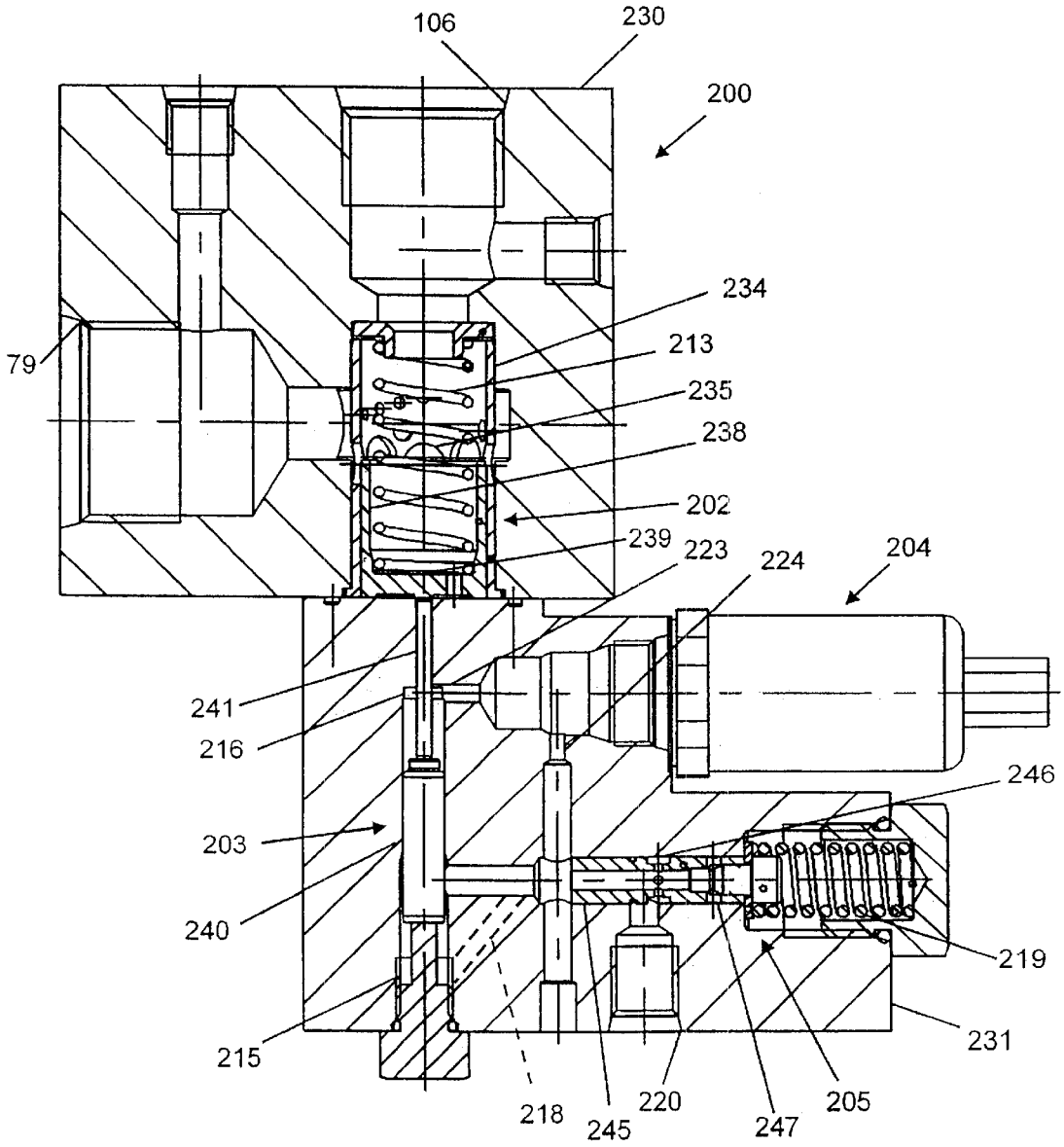
FIG. 13 is a sectioned view of the throttling valve of the present invention.
Figure 14:
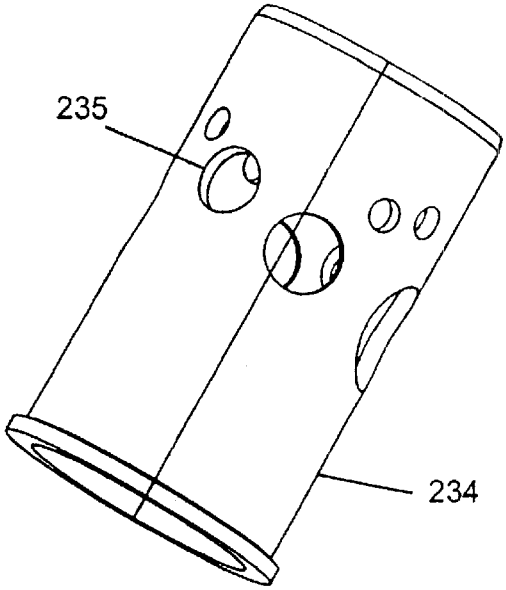
FIG. 14 is a perspective view of the sleeve used in the flow control valve of the present invention.

Referring now to FIG. 13 there is shown in sectioned view, throttling valve 200 and reference numerals used with respect to discussing the functioning of throttling valve 200 in FIG. 12 will apply to FIG. 13. Throttling valve 200 shown in FIG. 13 has a first casing section 230 containing flow control valve 202 and a second casing section 231 containing mechanical actuator 203, pressure control valve 204 and pressure regulator valve 205. It is contemplated that first casing section 230 may be formed integral with pump housing 56. Accordingly throttling valve inlet is designated as reference numeral 79 which is the inlet in high pressure pump 55 that is in fluid communication with low pressure pump 23 and throttling valve outlet is designated as reference numeral 106 which is the inlet for high pressure pump 55. Within first casing section is a drilled passage providing fluid communication between throttling valve inlet and outlet, 79, 106. Within the drilled passage is a cylindrical sleeve 234 and reference may had to FIG. 14 which shows a perspective view of sleeve 234. In the preferred embodiment, one axial end of sleeve 234 is adjacent throttling valve outlet 106 and the opposite axial end of sleeve 234 is adjacent second casing section 231. In between the axial ends of sleeve 234 is a plurality of longitudinally spaced orifice openings 235 in fluid communication with throttling valve inlet 79. The orifice openings permit low pressure pump fluid to flow from throttling inlet 79 through orifice openings 235 into the interior of sleeve 234 and out through throttling outlet 106. Each orifice opening 235 is dimensionally sized relative to its longitudinal position with respect to throttling inlet 79. In the preferred embodiment, the largest orifice openings 235 are positioned closest to the closed axial end of sleeve 235, i.e., adjacent second casing section 231.

Within sleeve 234 is a slidable hollow piston 238 which has a closed end 239 adjacent second casing section 231. Flow control valve spring 213 has one end seated against hollow piston closed end 239 and the other end seated against throttling valve outlet 106 biasing hollow piston closed end out of sleeve 234 and into contact with abutting second casing section 231. In this position which is shown in FIG. 13 flow control valve 202 is wide open and maximum flow occurs between throttling valve inlet 79 and outlet 106. As explained with respect to the discussion of FIG. 12, mechanical actuator 203 under the control of solenoid actuated control valve 204 regulates the position of piston 238 in sleeve 235. As is well known in HEUI applications, during cold start of the engine, the engine oil has a viscosity significantly different than that when the engine is at normal operating temperature. Further the force to move hollow piston 238 against the flow (i.e., to close) increases as the viscosity increases. It is important to keep the low pressure pump flow at a maximum at the time of cold start and during warm-up of the engine until oil thins to a desired viscosity, even if initial control instructions from the ECM have to be overridden. The sleeve/piston/variable orifice arrangement discussed for flow control valve 202 is somewhat ideal for this application. Specifically, orifice openings 235 can be set to produce a two-staged flow having a first stage which leaves the valve open and sluggish for a limited travel distance and a second stage where the flow can be precisely metered. As the viscosity of the oil thins, the force required to move the valve diminishes and places it into the second stage where it becomes extremely responsive to slight force changes.

Those skilled in the art will recognize that many geometrical variations in the sleeve/piston arrangement shown in FIG. 13 are possible. For example, variable orifice openings 235 could be provided in piston 238 instead of sleeve 234. The positions of throttling valve inlet and outlet 79, 106 could be reversed or both could be longitudinally positioned along sleeve 234. While the variations mentioned are possible and functional, the preferred arrangement for valve stability and valve response is as shown in FIG. 13.

Referring still to FIG. 13, mechanical actuator 203 simply comprises a shuttle or spool 240 sealingly disposed within a drilled passage in second casing 231. Attached to one end of spool 240 is an actuator plunger 241 in contact with piston closed end 239. At one end of spool 240 is closing passage 215 which receives fluid at regulated pressure $P_R$ and at the opposite end of spool 240 is control passage 216 receiving fluid at control pressure $P_C$. Pressure in closing passage 215 exerts a force on spool 240 tending to move spool 240 upward in the plane of the drawing shown in FIG. 13 against piston 238. Pressure in control passage 216 exerts a force on spool 240 tending to move spool 240 downward in the plane of the drawing shown in FIG. 13 out of second casing 231. Spring bias 213 plus the pressure in control passage 216 acts against the pressure in closing passage 215.

The advantage of a pilot operated (i.e., spool 240) valve compared to a solenoid operated flow control valve can now be explained. First as a matter of definition:

$Q_{IN}$=inlet flow from charge pump 23;

$A_{MV}$=Area opening of variable orifices 235 in flow control valve 202;

$P_R$=limited pressure, for example 40 bar, established by regulating valve 205;

$A_{PV}$=pilot valve area defined as diameter of spool 240;

$P_C$=control pressure established by pressure control solenoid valve 204;

$X_{PV}$=axial movement of spool 240 (until stopped by spring 213);

$Q_{PV}$=flow across variable orifices 235 in sleeve 234.

For throttling valve 200 as defined, the proportionalities producing valve control are as follows:

$Q_{IN} \sim A_{MV}$;

$A_{MV} \sim X_{PV}$;

$X_{PV} \sim \Delta P$;

$\Delta P = P_R - P_C$

For a flow control valve, one must reference the proportionality $Q_{PV} \sim \Delta P^{1/2}$. Controlling the flow linearly with respect to current from a solenoid operated flow control valve will then produce a $X_{PV}$, vs. current curve that is second order. This translates to poor control at the low end of the flow curve in the throttling valve. Utilizing the pilot operated pressure control valve disclosed, one must reference the fact that $\Delta P = P_R - P_C$. Since $P_R$ is a constant, this relationship is always linear, thus a linear $P_C$ vs. current curve will produce a linear relationship between the current and $X_{PV}$, this is the preferred control relationship.

Pressure regulating valve 205 is conventional and will not be described in detail herein. In FIG. 13, a regulating spool 245 in regulating valve 205 is shown in its free state in which $P_0$ at regulating valve inlet 220 is less than or equal to $P_R$. As $P_0$ becomes greater than or equal to $P_R$, the pressure in regulating valve outlet 218 moves regulating spool 245 towards the right as viewed in FIG. 13 against the bias of regulating spring 219. A land 246 in regulating spool 245 comes in line with a land (not shown) in regulating valve body. As fluid at pressure $P_0$ continues to leak into regulating valve outlet 218, regulating spool 245 continues to move towards the right, as viewed in FIG. 13, until a cross hole 247 reaches a position whereat it opens to a spring chamber (i.e., sump). This vents a small amount of oil at $P_R$ from valve outlet 218 moving regulator spool 245 towards the left to its modulated position whereat land 246 aligns with the land in the valve body.

Figure 15:
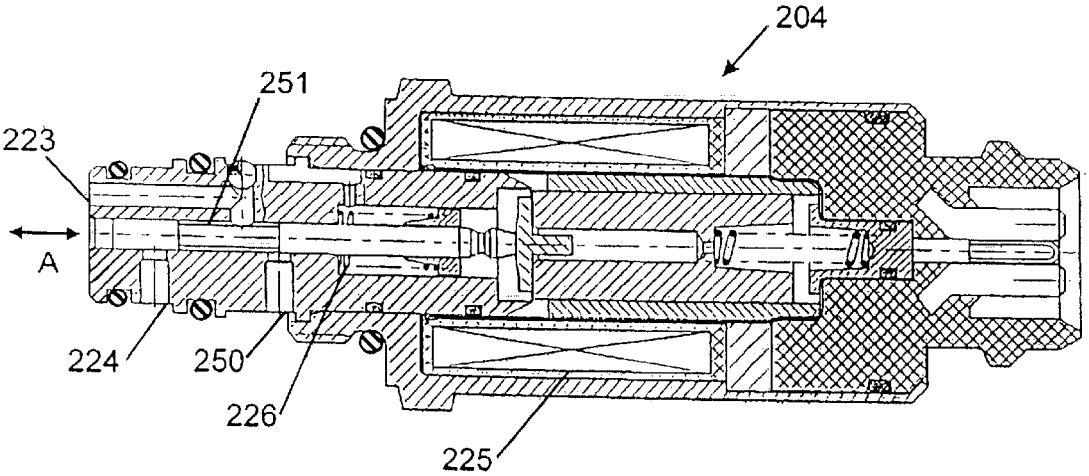
FIG. 15 is a sectioned view of a solenoid actuated pressure control valve used in the throttling valve of the present invention; and, FIG. 16 is a schematic view of an alternative embodiment of the present invention similar to FIG. 12.

Solenoid actuated pressure control valve 204 is also conventional and a conventional solenoid valve is shown in FIG. 15. The sump drain diagrammatically shown in FIG. 12 is shown as drain port 250 in FIG. 15. A control spool 251 is configured to close or open either control pressure inlet 224 or drain port 250 providing selective communication with control valve outlet 223. Control spool 251 includes a control spring seat 252 swaged thereto and control spring 226 biases control spool 251 to the right in the plane of FIG. 15. When current is generated in the solenoid wiring 225 an electrical field moves control spool 251 toward the left in the plane of the drawing shown in FIG. 15 against the bias of control spring 226. Fluid at regulated pressure $P_R$ enters control inlet 224 and builds pressure in control outlet 223 and also in the "A" direction against control spring 226 to establish flow from control outlet 223 to drain outlet 250 and thereby establish modulation of the control valve 204. The pressure build in the "A" direction is related to the current level inputted to solenoid 225 and is usually stored in a look-up table in ECM 18 whereby control of pump 55 is effected.

Figure 16:
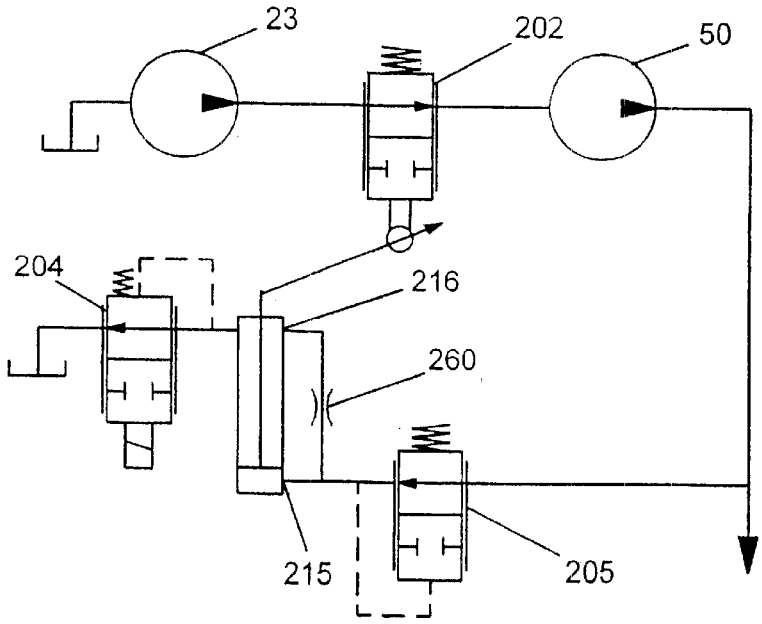

An alternative embodiment is illustrated in FIG. 16 which uses similar components as that set forth in the preferred embodiment and the same reference numerals used in describing the preferred embodiment will apply to the alternative embodiment. FIG. 16 is cited as an alternative embodiment only because it discloses a pilot operated throttling valve and in particular a flow control valve regulated by a mechanical actuator as discussed above for FIGS. 12 and 13. In FIG. 16 an orifice 260 is provided between the closing and control ends 215, 216 of mechanical actuator 203. Under static conditions, i.e., when flow control valve 204 is closed (no flow), actuator spool 240 is balanced and flow control spring 213 biases flow control valve 202 into a full open position. However, this alternative embodiment functions during normal operation by solenoid control valve 204 operating to cause a controlled flow of fluid through control end 216 of mechanical actuator 203 through solenoid control valve 204 to drain. The flow of fluid through orifice 260 results in a pressure drop establishing the pressure differential on actuator spool 240 to control the slave flow control valve 202 as described above. The fluid flow through solenoid control valve 204 exposes the solenoid actuated control valve to the viscosity changes of the fluid and the variations in the flow forces which are avoided in the solenoid actuated control valve 204 in the preferred embodiment illustrated in FIGS. 12–15. In the preferred embodiment, solenoid actuated control valve 204 is only controlling pressure, and communication to drain port 250 is only that necessary to establish the desired control pressure $P_C$ so that flow considerations through the valve are insignificant in the "meter in" arrangement of the preferred embodiment. In the alternative "meter out" arrangement flow considerations through solenoid actuated control valve 204 have to be considered in the control valve design and the solenoid sized accordingly. For this reason, the alternative embodiment is not preferred and is simply disclosed to show an alternative pilot valve arrangement which can be used in the inventive throttled inlet pump/throttling valve system applications of the invention.

The invention has been described with reference to a preferred and alternative embodiment. Obviously alterations and modifications will occur to those skilled in the art upon reading and understanding the Detailed Description set forth herein. For example, the invention has been described with reference to a HEUI system where it has particular application. To a similar extent, a steering or hydraulic suspension system on a vehicle has similar considerations and a high pressure pump could be installed in such systems. Typically, those systems would not charge the inlet of pump so drain passages (e.g. drain passage 89) would not be provided for internal pump leakage. Also, the specifications discuss the throttling valve for use in a HEUI application which place specific demands on the throttling valve that are reflected in the throttling valve design. However, the inventive throttling valve and the inventive throttled inlet pump/throttling valve system disclosed herein can be used in other applications such as power steering pump applications or in unrelated industrial applications. It is intended to include all such modifications and alterations insofar as they come within the scope of the present invention.

Various features of the invention are set forth in the following claims.

What is claimed is:

1. In an internal combustion engine having a hydraulically-actuated electronically-controlled fuel injection system of the type including a fuel injector valving high pressure fluid in response to commands from an ECM to timely inject a metered quantity of fuel into the engine's combustion chamber; the injector in fluid communication with the outlet of a high pressure pump having an inlet in fluid communication with a low pressure pump; the improvement comprising:

a high pressure pump having a housing and a plurality of piston bores within the housing; a piston within each piston bore having one end in contact with a formed shaft portion rotatable relative to the housing, each piston movable in its piston bore to uncover and cover a suction opening of set area and pump fluid at its opposite end through a discharge vent opening in the cylinder; a check valve at each discharge vent opening and each discharge vent opening in fluid communication with the pump outlet whereby the flow of fluid pumped by the pump is generally constant throughout the operating range of the pump.

2. The improvement of claim 1, wherein the ECM develops signals controlling the operation of the injector for fuel metering without modifying the flow from the pump outlet to the injector, wherein the formed shaft portion is a swash plate, and the orientation between the swash plate and the pistons is fixed throughout the operating speed of the pump.

3. The improvement of claim 2, further comprising a pressure controlled throttling valve at the inlet of the high pressure pump, the ECM regulating the inlet flow of fluid through the pressure control valve to reduce the flow of fluid to the high pressure pump when predetermined engine conditions are sensed by the ECM.

4. The improvement of claim 3, further comprising an annular discharge chamber in fluid communication with the discharge opening and an outlet port of the pump and a reed flapper valve at the outlet of each piston bore's discharge opening functioning as a check valve, whereby high pressure fluid pumped by all pistons is united in the discharge chamber to dissipate pump pulsations.

5. The improvement of claim 3, further comprising a rail pressure control valve between the fuel injectors and the high pressure pump outlet under the control of the ECM for varying the flow of pump output fluid to the fluid injectors.

6. The improvement of claim 3, wherein the pump outlet port is in direct unaltered fluid communication with the injectors whereby the output flow of the pump transmitted to the fuel injectors is not varied.

7. The improvement of claim 1, wherein the set area of the suction opening is determined as a function of the relationship $$QA \cdot \Delta P^{1/2} \cdot t$$

where

"Q" is the quantity of fluid flowed through the suction opening for a time,

"A" is the area of the suction opening,

"ΔP" is the pressure drop of the fluid through the suction opening, and

"t" is the time the suction opening is open during the suction stroke.

8. The improvement of claim 7, wherein the pressure drop through the suction opening is variably controlled after the operating speed of the pump has been reached by variably changing the inlet pressure.

9. In a diesel engine equipped with hydraulically actuated electronically controlled unit fuel injectors having a high pressure pump in fluid communication with a high pressure rail connected to the injectors in turn utilizing solenoids actuated by an ECM to control valving of high pressure pump fluid within the injectors to timely and variably actuate the injectors, the improvement comprising:

a fixed displacement piston pump having a substantially constant flow over its operating range in unaltered fluid communication with said high pressure rail whereby an electronically controlled, pressure regulating valve controlling pump pressure in said high pressure rail is alleviated.

10. The improvement of claim 9, further comprising a safety relief valve in fluid communication with the outlet port of the high pressure pump for maintaining the pressure within said high pressure rail below a set value.

11. The improvement of claim 10 wherein the pump comprises an axial piston pump and has a plurality of open ended piston bores each piston bore containing an axially movable piston extending through one end of said bore, a suction slot establishing fluid communication through the slot from pump inlet to piston bore during a portion of piston suction stroke travel while preventing fluid communication between piston bore and pump inlet during the compression piston stroke and a discharge vent port at its opposite end in fluid communication with a discharge chamber in turn in fluid communication with a pump outlet port.

12. The improvement of claim 11 further including a reed type flapper valve adjacent and between said pump's orifice and said discharge chamber.

13. The improvement of claim 9, further comprising a low pressure pump supplying fluid at low pressure to the inlet of the high pressure pump; an electronically actuated pressure control throttling valve at the inlet of said high pressure pump and the throttling valve actuated by the ECM to variably retard the flow of inlet fluid to the high pressure pump.

14. A constant flow, fixed displacement, piston pump comprising:

a non-rotatable housing containing a plurality of piston bores;

a rotatable shaft having a formed shaft portion;

a piston movable within each bore having one end extending through a bore end and in sliding contact with the formed shaft portion to impart movement to the piston while the piston's opposite end is adjacent an outlet check valve at the opposite bore end;

the pump having a discharge chamber in fluid communication with all piston check valves and with the pump outlet; and, each piston bore having a suction opening of set area in fluid communication with the pump inlet, the suction opening being sealed and opened by movement of each piston within its bore whereby fluid flow into the piston bore decreases in proportion to increases in shaft rotational speed after the operating speed of the pump has been reached.

15. The pump of claim 14, further comprising a check valve in the suction opening.

16. The pump of claim 14, wherein each piston is hollow and open at its end adjacent the outlet check valve, each piston having a piston opening positioned between its ends and a piston check valve in the piston opening, the opening in fluid communication with the piston opening for a set piston travel distance during the piston's suction stroke and out of fluid communication with the piston opening during a compression stroke of the piston.

17. The pump of claim 14, wherein the outlet check valve is a reed flapper valve whereby high pressure fluid pumped by all pistons is united in the discharge chamber to dissipate pump pulsations.

18. The pump of claim 17, wherein the housing defines a housing chamber, and wherein the piston bores are formed in a cylinder fixed to the housing and the shaft journalled in the housing; the housing having an annular inlet chamber in fluid communication with the pump inlet and with the opening, and a drain passage in the housing in fluid communication with the housing chamber and the inlet chamber whereby internal pump leakage is drained through the pump inlet when the inlet fluid is not pressurized.

19. The pump of claim 18, further comprising a throttling valve at the inlet of the pump.

20. The pump of claim 14, wherein the set area of the opening is determined as a function of the relationship $$QA \cdot \Delta P^{1/2} \cdot t$$

where

"Q" is the quantity of fluid flowed through the opening for a time,

"A" is the area of the opening,

"ΔP" is the pressure drop of the fluid through the opening, and

"t" is the time the opening is open during the suction stroke.

21. The pump of claim 20, wherein the pressure drop through the suction opening is variably controlled after the operating speed of the pump has been reached by variably changing the inlet pressure.

22. The pump of claim 14, further comprising a tail shaft extending along the longitudinal centerline of the pump; a spherical bearing mounted to the tail shaft; a retainer plate having a central opening smaller than the outside spherical diameter of the spherical bearing and in contact with the outside spherical surface of the spherical bearing, the retainer plate further having circumferentially spaced openings receiving slippers therein and a spring biasing the spherical bearing towards the shaft portion.

23. The high pressure pump of claim 1, wherein the pump is an axial piston pump.

24. The high pressure pump of claim 1, wherein the suction opening is formed in the piston bore.

25. The high pressure pump of claim 1, wherein the suction opening is a slot.

26. The high pressure pump of claim 1, wherein the piston bores are spaced about the centerline of the pump.

27. The high pressure pump of claim 1, wherein the formed shaft portion is a swash plate.

28. The improvement of claim 10, wherein the piston pump has a rotatable shaft having a formed shaft portion and a stationary cylinder having a plurality of open ended piston bores spaced about said shaft; each piston bore containing a movable piston extending through one end of said bore in contact with said formed shaft portion, a suction slot establishing fluid communication through the slot from pump inlet to piston bore during a portion of piston suction stroke travel while preventing fluid communication between piston bore and pump inlet during the compression piston stroke and a discharge port at its opposite end in fluid communication with a discharge chamber in turn in fluid communication with a pump outlet port.

29. The improvement of claim 28, further comprising a check valve adjacent and between said pump's orifice and said discharge chamber.

30. The pump of claim 14 wherein the suction opening is located in the piston bore and is transversely positioned at a set distance between the piston bore ends.

31. The pump of claim 14 wherein the suction opening is located in the piston bore.

32. The pump of claim 14, wherein the pump is an axial piston pump.

33. The pump of claim 14, wherein the suction opening is a slot.

34. The pump of claim 14, wherein the piston bores are spaced about the centerline of the pump.

35. The pump of claim 14, wherein the formed shaft portion is a swash plate.

* * * * *